US008387425B2

(12) United States Patent
Ben-Aharon et al.

(10) Patent No.: US 8,387,425 B2
(45) Date of Patent: Mar. 5, 2013

(54) MOVABLE KEY COMBINATION ELEMENT AND LOCK ASSEMBLY

(75) Inventors: Effi Ben-Aharon, Hod HaSharon (IL); Dani Markbreit, Azur (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 0 days.

(21) Appl. No.: 13/062,011

(22) PCT Filed: Aug. 25, 2009

(86) PCT No.: PCT/US2009/054835

§ 371 (c)(1), (2), (4) Date: Mar. 3, 2011

(87) PCT Pub. No.: WO2010/027760

PCT Pub. Date: Mar. 11, 2010

(65) Prior Publication Data

US 2011/0146360 A1 Jun. 23, 2011

(30) Foreign Application Priority Data

Sep. 7, 2008 (IL) ..... 193931

(51) Int. Cl.
*E05B 35/00* (2006.01)
*E05B 19/04* (2006.01)

(52) U.S. Cl. ..... 70/405; 70/395; 70/398; 70/399; 70/406; 70/407; 70/409; 70/411

(58) Field of Classification Search ..... 70/395, 70/398, 399, 405–407, 409, 411
See application file for complete search history.

(56) References Cited

U.S. PATENT DOCUMENTS

| | | | | |
|---|---|---|---|---|
| 195,118 | A * | 9/1877 | Gerard | 70/492 |
| 3,877,267 | A * | 4/1975 | Harris, Jr. | 70/358 |
| 4,377,082 | A * | 3/1983 | Wolter | 70/493 |
| 4,434,636 | A * | 3/1984 | Prunbauer | 70/358 |
| 5,024,071 | A * | 6/1991 | Shafirkin | 70/387 |
| 5,123,268 | A * | 6/1992 | Eizen | 70/359 |
| 5,170,651 | A | 12/1992 | Errani | |
| 5,437,176 | A * | 8/1995 | Keller | 70/358 |

(Continued)

FOREIGN PATENT DOCUMENTS

| | | |
|---|---|---|
| DE | 1093253 | 11/1960 |
| EP | 0416500 | 3/1991 |

(Continued)

OTHER PUBLICATIONS

Written Opinion of PCT/US2009/054835.
UK Search Report for Application GB0816412.1.

*Primary Examiner* — Suzanne Barrett
*Assistant Examiner* — Ifeolu Adeboyejo
(74) *Attorney, Agent, or Firm* — Dekel Patent Ltd.; David Klein

(57) ABSTRACT

A key device for use with more than one lock, the key device including a shaft portion, and at least one movable key combination element retained within the shaft portion and including first and second portions adjacent one another, the first portion of the at least one movable key combination element being located along on the shaft portion and the second portion of the at least one movable key combination element being located offset to the first portion.

7 Claims, 8 Drawing Sheets

U.S. PATENT DOCUMENTS

| | | | | |
|---|---|---|---|---|
| 5,520,035 | A | 5/1996 | Eizen | |
| 5,894,750 | A * | 4/1999 | Liaw | 70/359 |
| 6,508,091 | B1 * | 1/2003 | Donatini | 70/359 |
| 7,086,259 | B2 * | 8/2006 | Almoznino | 70/359 |
| 2003/0074939 | A1 | 4/2003 | Braun | |
| 2011/0072867 | A1 * | 3/2011 | Haviv et al. | 70/357 |

FOREIGN PATENT DOCUMENTS

| | | |
|---|---|---|
| EP | 1728944 | 12/2006 |
| FR | 2522053 | 8/1983 |
| FR | 2759406 | 8/1998 |
| GB | 2412689 | 10/2005 |

* cited by examiner

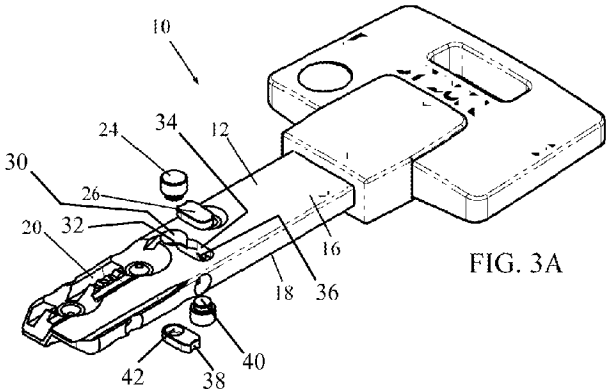
FIG. 3A
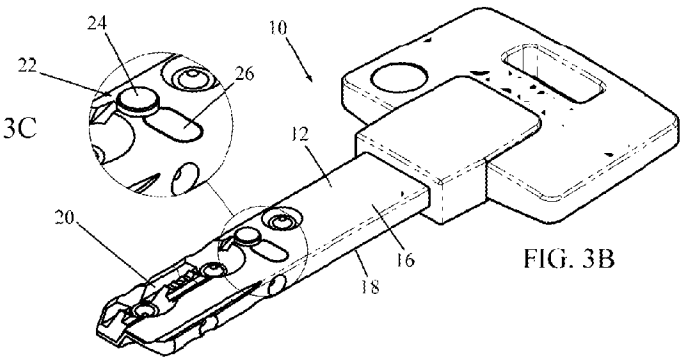
FIG. 3B
FIG. 3C
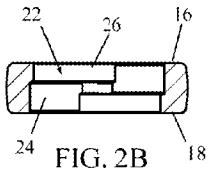
FIG. 2B
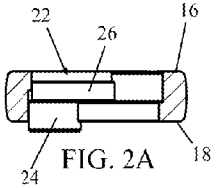
FIG. 2A
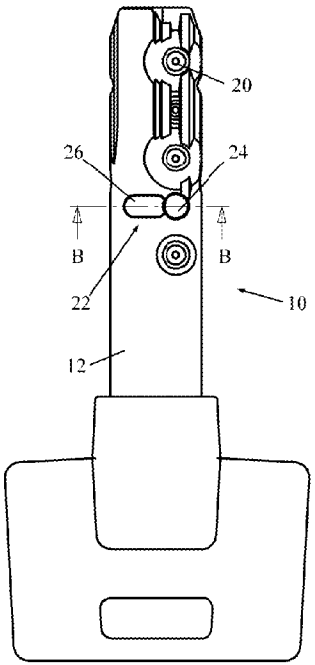
FIG. 1B
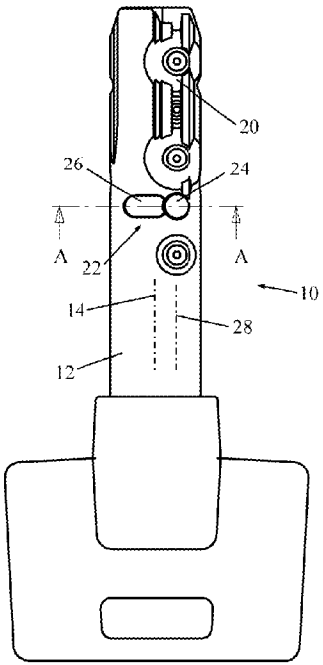
FIG. 1A

MOVABLE KEY COMBINATION ELEMENT AND LOCK ASSEMBLY

The present invention relates to locking apparatus generally and more particularly to a key combination element movably disposed in a key blank or key that interacts with a lock assembly.

BACKGROUND OF THE INVENTION

Cylinders locks are also known that are equipped with a movable element (e.g., pin) disposed in the key blade. An auxiliary locking pin is spring-loaded in the cylinder housing. Upon insertion of the key in the keyway, the movable element aligns with the auxiliary locking pin and interacts therewith to align with the shear line and permit rotation of the plug. Even if a would-be thief were to pick the key-cut combination of the key, he still would not defeat the lock without additionally aligning the movable element with the auxiliary locking pin. The latter action is very difficult without an authorized key, and thus the lock provides high security. Such locks are described, for example, in U.S. Pat. Nos. 5,520,035, 5,784,910 and 5,839,308, assigned to the assignee of the present application. These patents describe a key blank that includes a generally elongate shaft portion defining a key combination surface adapted to have formed thereon key cuts which define a key combination. The key blank includes a movable pin element retained within the elongate shaft portion. The movable pin element may be displaced in a single direction, outwardly from the key combination surface.

SUMMARY OF THE INVENTION

The present invention seeks to provide an improved key combination element movably disposed in a key device (key blank or key) that interacts with a lock assembly, as is described more in detail hereinbelow.

It is noted that throughout the specification and claims the term "key device" refers to a key blank or a key made from a key blank with key cuts formed thereon.

The key device of the present invention not only opens the lock assembly of the present invention, but is also compatible with locks (that is, can be used to open locks) made in accordance with the abovementioned U.S. Pat. Nos. 5,520,035, 5,784,910 and 5,839,308, among others, whereas the key devices of those patents cannot be used to open the lock assembly of the present invention.

There is thus provided in accordance with an embodiment of the present invention a key device for use with more than one lock, the key device including a shaft portion, and at least one movable key combination element retained within the shaft portion and including first and second portions adjacent one another, the first portion of the at least one movable key combination element being located along the shaft portion and the second portion of the at least one movable key combination element being located offset to the first portion, the at least one movable key combination element being displaceable with respect to the shaft portion, wherein the first lock includes a rotatable plug having a keyway, a pressing element in the rotatable plug arranged to press against the second portion of the at least one movable key combination element thereby to move an auxiliary locking element disposed in the first lock to a shear line to permit rotation of the plug, and wherein the second lock includes a rotatable plug having a keyway, and a pressing element in the rotatable plug arranged to press against the second portion of the at least one movable key combination element thereby to move an auxiliary locking element disposed in the second lock to a shear line to permit rotation of the plug, wherein the pressing elements of the first and second locks press against two different locations offset from each other on the second portion of the at least one movable key combination element.

Embodiments of the invention may include one or more of the following features.

The second portion of the at least one movable key combination element is formed with a peripheral cutout and a portion of an outer contour of the first portion of the at least one movable key combination element slidingly contacts the peripheral cutout.

The first and second portions of the at least one movable key combination element move independently of each other.

The first portion of the at least one movable key combination element includes a body movably mounted in a hole formed in the shaft portion, the hole being formed with a lower shoulder, and displacement of the first portion of the at least one movable key combination element is constrained by the body abutting against the shoulder.

The second portion of the at least one movable key combination element includes an oblong body movably mounted in an oblong aperture formed in the shaft portion, the oblong aperture being formed with a lower shoulder, and displacement of the second portion of the at least one movable key combination element is constrained by the oblong body abutting against the shoulder.

A pair of movable key combination elements may be mounted on opposite sides of the shaft portion. In such an embodiment, the first portion of each of the movable key combination elements includes a first body movably mounted in a hole formed in the shaft portion, the hole being formed with a lower shoulder, and wherein displacement of the first portion of the at least one movable key combination element is constrained by the first body abutting against the shoulder, and wherein the second portion of each of the movable key combination elements includes an oblong body movably mounted in an oblong aperture formed in the shaft portion, the oblong aperture being formed with a lower shoulder, and wherein displacement of the second portion of the at least one movable key combination element is constrained by the oblong body abutting against the shoulder, and each first body has a shaft extending therefrom and each oblong body is formed with a recess, and the shaft of the first body of one of the movable key combination elements fits into the recess of the oblong body of the other of the movable key combination elements.

There is also provided in accordance with an embodiment of the present invention a lock and key combination including a key device including a shaft portion, and at least one movable key combination element retained within the shaft portion and including first and second portions adjacent one another, the first portion of the at least one movable key combination element being located along the shaft portion and the second portion of the at least one movable key combination element being located offset to the first portion, the at least one movable key combination element being displaceable with respect to the shaft portion, and a lock assembly including a rotatable plug having a keyway, and a pressing element in the rotatable plug arranged to press against the second portion of the at least one movable key combination element thereby to move an auxiliary locking element disposed in the second lock to a shear line to permit rotation of the plug, wherein the pressing element is not collinear with the auxiliary locking element.

The lock and key combination may further include a cap that sits in a hole in the rotatable plug and closes the pressing element in the rotatable plug, the cap having an upper contour rounded to a partially cylindrical shape to match an outer contour of the rotatable plug. The upper contour of the cap self-aligns the cap so it seats properly in the hole.

BRIEF DESCRIPTION OF THE DRAWINGS

The present invention will be understood and appreciated more fully from the following detailed description, taken in conjunction with the drawings in which:

FIGS. 1A and 1B are simplified top view illustrations of a key device including a key combination element movably disposed therein, constructed and operative in accordance with an embodiment of the present invention, with the key combination element respectively jutting out and flush with the shank (blade) of the key device;

FIGS. 2A and 2B are simplified sectional view illustrations of the key device of FIGS. 1A and 1B, respectively taken along lines A-A and B-B in FIGS. 1A and 1B;

FIGS. 3A and 3B are simplified exploded and pictorial illustrations of the key device of FIGS. 1A and 1B, respectively;

FIG. 3C is a close-up view of the key combination element shown in FIG. 3A;

DETAILED DESCRIPTION OF EMBODIMENTS

Figure 4A:
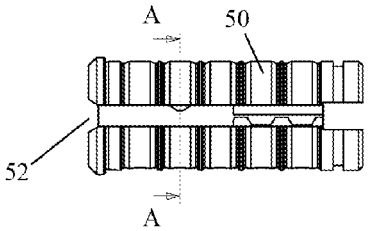
FIG. 4A PRIOR ART
FIGS. 4A, 4B and 4C are simplified side-view, sectional and pictorial illustrations, respectively, of a prior art lock assembly that includes a pin plug (pin tumbler) with an auxiliary locking element that interacts with a movable element in a key device to align with a shear line and permit rotation of the plug.

Reference is now made to FIGS. 1A-3C, which illustrate a key device 10, constructed and operative in accordance with a non-limiting embodiment of the present invention.

Key device 10 is manufactured with a generally elongate shaft portion 12 extending along a shaft axis 14 and defining first and second generally flat oppositely directed key combination surfaces 16 and 18. Key device 10 can be provided as a key blank with no or substantially no key cuts formed thereon (the key cuts being formed later by a locksmith and the like). Key device 10 may be include a row of key cuts 20 which define a key combination formed along the first key combination surface 16 and/or along the second key combination surface 18. Accordingly, key device 10 may define a reversible key, with symmetric key combination surfaces 16 and 18. Alternatively, key device 10 may have a single key combination surface or different key combination surfaces.

One or more movable key combination elements 22 are retained within elongate shaft portion 12. Movable key combination element 22 includes first and second portions 24 and 26 adjacent one another. The first portion 24 is located along shaft portion 12, e.g., along a keyway guide axis 28 (that is, some arbitrary reference axis along the key) and the second portion 26 is located offset to the first portion 24, e.g., parallel to keyway guide axis 28. In the illustrated embodiment the key cuts 20 are formed along the keyway guide axis 28. The keyway guide axis 28 is parallel to or collinear with the shaft axis 14. Movable key combination element 22 is displaceable in a direction normal to the first and second key combination surfaces 16 and 18.

In accordance with a non-limiting embodiment of the present invention, the first and second portions 24 and 26 of movable key combination element 22 move independently of each other.

Reference is particularly made to FIG. 3C. In accordance with a non-limiting embodiment of the present invention, the first portion 24 includes a body (e.g., a generally cylindrical body) movably mounted in a hole 30 formed in elongate shaft portion 12. Hole 30 is formed with a lower shoulder 32 (e.g., hole 30 is formed with a counterbore). Displacement of the first portion 24 normal to the first and second key combination surfaces 16 and 18 is constrained by the body of first portion 24 abutting against the shoulder 32.

The second portion 26 includes an oblong body movably mounted in an oblong aperture 34 formed in elongate shaft portion 12. The oblong aperture 34 is formed with a lower shoulder 36. Displacement of the second portion 26 normal to the first and second key combination surfaces 16 and 18 is constrained by the oblong body abutting against the shoulder 36.

In accordance with a non-limiting embodiment of the present invention, the second portion 26 is formed with a peripheral cutout 38 and a portion of an outer contour of the first portion 24 slidingly contacts the peripheral cutout 38. The sliding of the two parts at the peripheral cutout 38 helps prevent seizure of the parts during operation of the key device in a lock. (As will be explained below, a pressing element can press against the second portion 26 at different places. One of the places to be pressed upon can create a turning moment on element 22. If first portion 24 did not slidingly contact peripheral cutout 38, there could be seizure of the parts due to the turning moment. The sliding contact prevents the turning moment from being created and thus prevents seizure.)

In accordance with a non-limiting embodiment of the present invention, the key device 10 includes a pair of movable key combination elements 22, one of which is mounted on the first key combination surface 16, and the other of which is mounted on the second key combination surface 18.

The body of the first portion 24 may have a shaft 40 extending therefrom and the oblong body of the second portion 26 may be formed with a recess 42, wherein the shaft 40 of one of the movable key combination elements fits (e.g., with a tight press fit) into the recess 42 of the other of the movable key combination elements.

The key device 10 not only opens the lock assembly of the present invention, but is also compatible with locks (that is, can be used to open locks) made in accordance with the abovementioned U.S. Pat. Nos. 5,520,035, 5,784,910 and 5,839,308, among others, whereas the key devices of those patents cannot be used to open the lock assembly of the present invention, as is now explained.

Figure 4B:
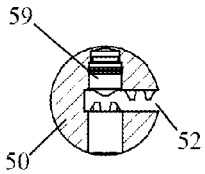
FIG. 4B PRIOR ART
Figure 4C:
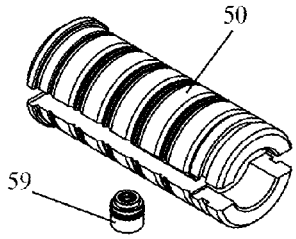
FIG. 4C PRIOR ART

Reference is now made to FIGS. 4A, 4B and 4C, which illustrate a prior art lock assembly, referred to as the first lock, such as a lock made in accordance with the abovementioned U.S. Pat. Nos. 5,520,035, 5,784,910 and 5,839,308, among others. The first lock includes a rotatable plug 50 having a keyway 52.

Figure 5A:
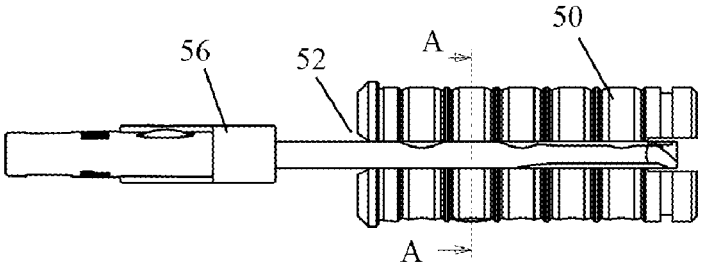
FIG. 5A PRIOR ART
FIG. 5A is a simplified side-view illustration of a prior art key device inserted in a keyway of the prior art pin plug, wherein the auxiliary locking element is at the shear line and in contact with the movable element in the key device.
Figure 6A:
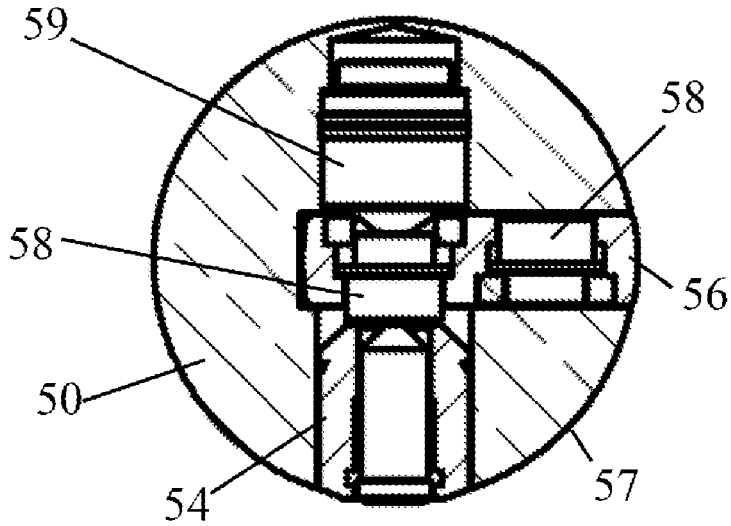
FIG. 6A PRIOR ART
FIG. 6A is a simplified sectional illustration of the prior art key device inserted in the keyway of the prior art pin plug, corresponding to FIG. 5A.

FIGS. 5A and 6A illustrate using a prior art key 56, such as a key made in accordance with the abovementioned U.S. Pat. Nos. 5,520,035, 5,784,910 and 5,839,308, among others. An auxiliary locking element 54 is arranged to be moved to a shear line 57 (the outer circumference of the plug 50) by means of a suitable key inserted in keyway 52. The auxiliary locking element 54 is shown as a telescoping pin, but other kinds of locking elements can also be used. Key 56 is inserted in keyway 52. Key 56 has a movable key combination element 58. The auxiliary locking element 54 is arranged to be moved to the shear line 57 when aligned and in contact with movable key combination element 58, so as to permit rotation of the plug 50. A pressing element 59 is disposed in plug 50 and provides a pressing force (such as by means of a coil spring) that urges movable key combination element 58 against auxiliary locking element 54. It is noted that key 56 is a symmetric key and thus has two movable key combination elements 58.

Figure 5B:
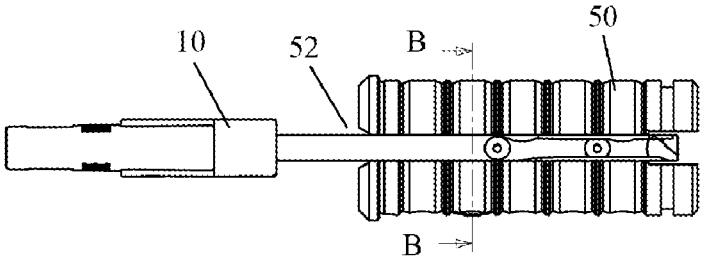
FIG. 5B is a simplified side-view illustration of the key device of FIGS. 1A and 1B inserted in the keyway of the prior art pin plug, wherein the auxiliary locking element is at the shear line and in contact with the movable element in the key device of FIGS. 1A and 1B.
Figure 6B:
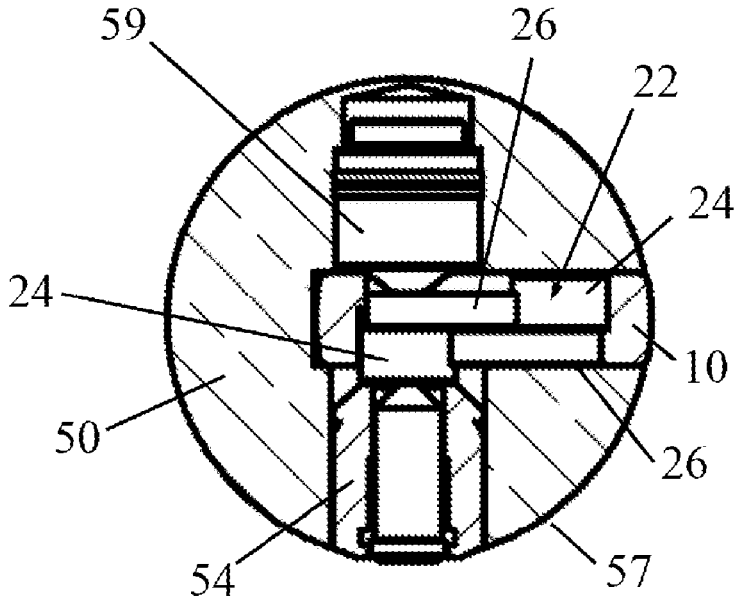
FIG. 6B is a simplified sectional illustration of the key device of FIGS. 1A and 1B inserted in the keyway of the prior art pin plug, corresponding to FIG. 5B.

Reference is now made to FIGS. 5B and 6B, which illustrate the key device 10 of FIGS. 1A and 1B inserted in the keyway 52 of the prior art pin plug 50. The pressing element 59 presses against the "upper" second portion 26 ("upper" in the sense of the drawing) of the movable key combination element 22 and the "lower" first portion of the movable key combination element 22 is aligned and in contact with auxiliary locking element 54, such that auxiliary locking element 54 is at the shear line 57 so as to permit rotation of the plug 50. Thus, key device 10 of the present invention opens the prior art lock assembly.

Figure 7A:
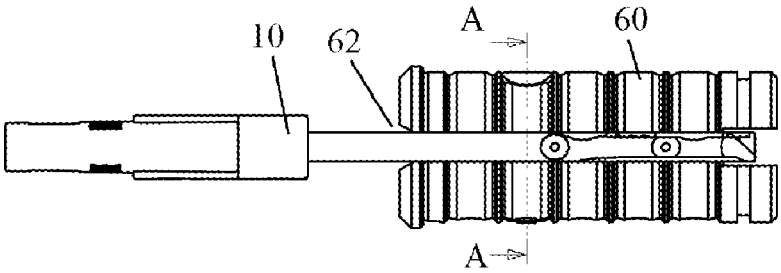
FIG. 7A is a simplified side-view illustration of the key device of FIGS. 1A and 1B inserted in a keyway of a pin plug of a lock assembly constructed in accordance with an embodiment of the present invention, wherein an auxiliary locking element is at the shear line and in contact with the movable element in the key device of FIGS. 1A and 1B.
Figure 8A:
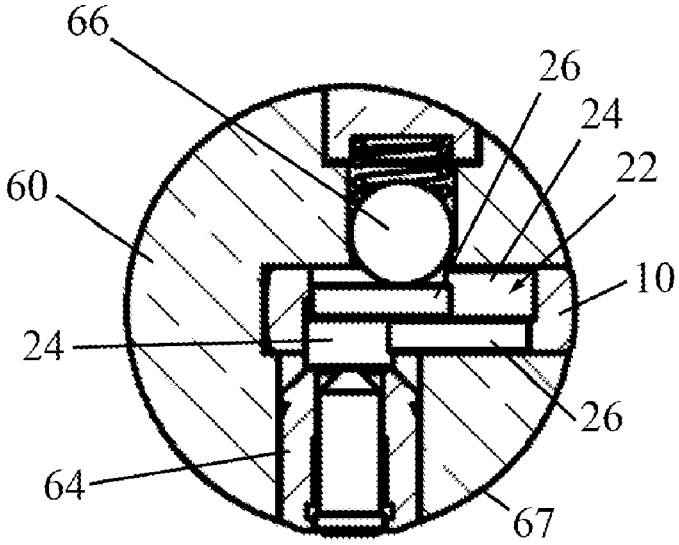
FIG. 8A is a simplified sectional illustration of the key device of FIGS. 1A and 1B inserted in the keyway of the pin plug, corresponding to FIG. 7A.

Reference is now made to FIGS. 7A and 8A, which illustrate the key device 10 inserted in a keyway 62 of a pin plug 60 of lock assembly constructed in accordance with an embodiment of the present invention. The lock assembly of this embodiment of the invention has a pressing element 66 that presses against the "upper" second portion 26 of the movable key combination element 22 and the "lower" first portion of the movable key combination element 22 is aligned and in contact with an auxiliary locking element 64, such that auxiliary locking element 64 is at shear line 67 so as to permit rotation of the plug 60. Thus, key device 10 of the present invention opens the lock assembly of the present invention.

It is noted that the pressing element 66 of this embodiment is offset (not collinear) with respect to auxiliary locking element 64. This is in contrast with the prior art lock of FIGS. 5A-6B, wherein pressing element 59 is collinear with respect to auxiliary locking element 54. It is further noted that, in contrast with the prior art, pressing element 66 of this embodiment is not necessarily pin-shaped, but can be spherical or other shapes.

Figure 7B:
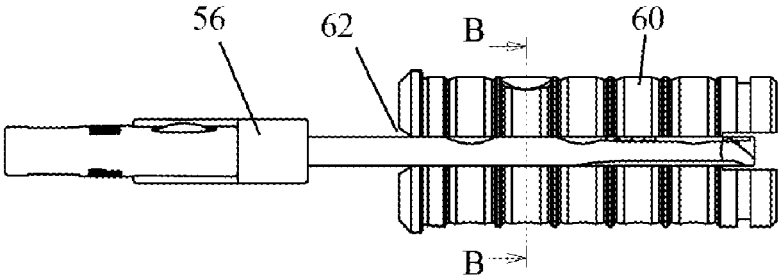
FIG. 7B is a simplified side-view illustration of a prior art key device inserted in the same keyway of the pin plug of the lock assembly of FIG. 7A, showing that the auxiliary locking element is not at the shear line.
Figure 8B:
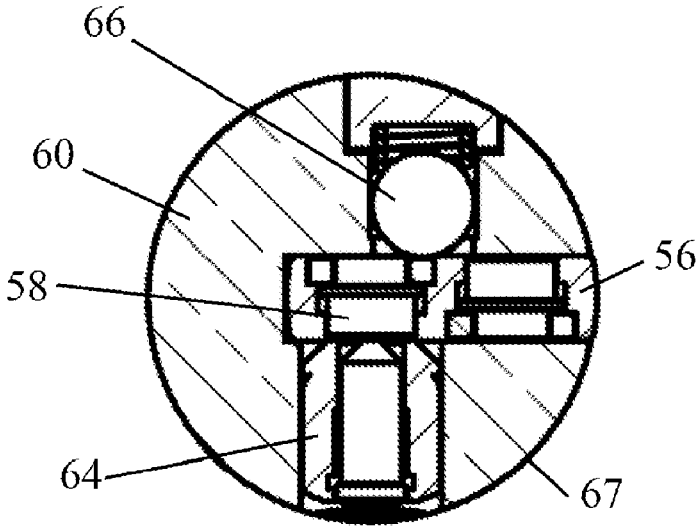
FIG. 8B is a simplified sectional illustration of the prior art key device inserted in the keyway of the pin plug, corresponding to FIG. 7B.

Reference is now made to FIGS. 7B and 8B, which illustrate the prior art key 56 device inserted in the same keyway 62 of the pin plug 60. It is seen in FIG. 8B that due to the offset of pressing element 66, the prior art movable key combination element 58 does not succeed to move the auxiliary locking element 64 to the shear line 67. (There is no urging force against element 58 from pressing element 66.) Thus, the prior art key 56 cannot operate the lock assembly of the present invention.

Figure 9A:
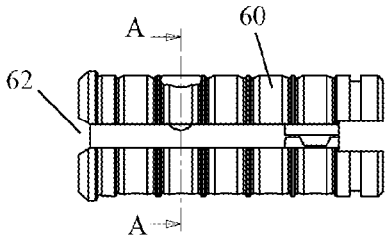
FIGS. 9A, 9B and 9C are simplified side-view, sectional and pictorial illustrations, respectively, of the lock assembly of FIG. 7A, constructed in accordance with an embodiment of the present invention.
Figure 9B:
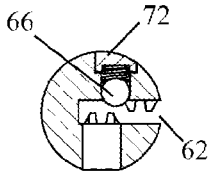
Figure 9C:
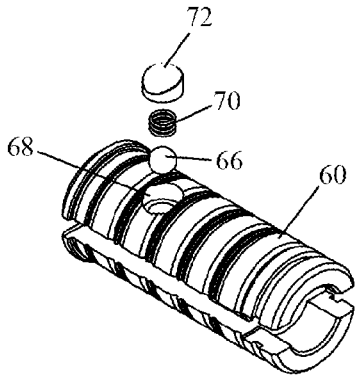

Reference is now made to FIGS. 9A, 9B and 9C, which illustrate the lock assembly of FIG. 7A, constructed in accordance with an embodiment of the present invention. The pressing element 66 may be installed in plug 60 through a hole 68. A coil spring 70 may provide the urging force, and a cap 72 may be used to close and secure pressing element 66 and spring 70 in plug 60. Cap 72 is round in cross-section to match round hole 68 (with a tight press fit, for example), and the upper contour of cap 72 is rounded to a partially cylindrical shape to match the outer contour of plug 60. This rounded, partially cylindrical contour of cap 72 serves to self-align cap 72 so it seats properly in hole 68.

Figure 10A:
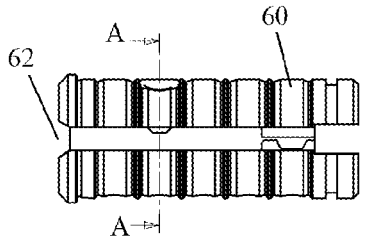
FIGS. 10A, 10B and 10C are simplified side-view, sectional and pictorial illustrations, respectively, of the lock assembly of FIG. 7A, constructed in accordance with another embodiment of the present invention.
Figure 10B:
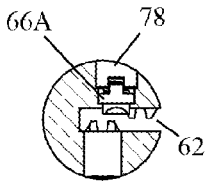
Figure 10C:
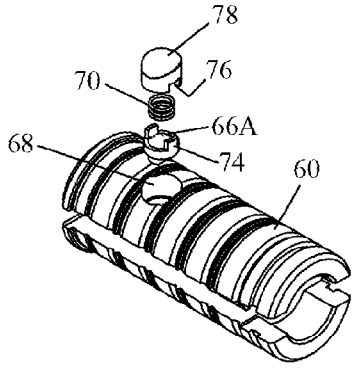

Reference is now made to FIGS. 10A, 10B and 10C, which illustrate the lock assembly of FIG. 7A, constructed in accordance with another embodiment of the present invention. As mentioned above, pressing element 66 is not necessarily spherical. In this embodiment, there is a pressing element 66A that as ears 74 that mate with grooves 76 formed in a cap 78.

The scope of the present invention includes both combinations and subcombinations of the features described hereinabove as well as modifications and variations thereof which would occur to a person of skill in the art upon reading the foregoing description and which are not in the prior art.

What is claimed is:

1. A key device for use with a first lock and a second lock, said key device comprising:

a shaft portion; and at least one movable key combination element retained within said shaft portion and comprising first and second portions adjacent one another, the first portion of said at least one movable key combination element being located along said shaft portion and the second portion of said at least one movable key combination element being located offset to said first portion, said at least one movable key combination element being displaceable with respect to said shaft portion;

wherein the first lock comprises:

a rotatable plug having a keyway;

a pressing element in said rotatable plug arranged to press against said second portion of said at least one movable key combination element thereby to move an auxiliary locking element disposed in said first lock to a shear line to permit rotation of said plug; and wherein the second lock comprises:

a rotatable plug having a keyway; and a pressing element in said rotatable plug arranged to press against said second portion of said at least one movable key combination element thereby to move an auxiliary locking element disposed in said second lock to a shear line to permit rotation of said plug, wherein the pressing elements of the first and second locks press against two different locations offset from each other on said second portion of said at least one movable key combination element.

2. The key device according to claim 1, wherein said second portion of said at least one movable key combination element is formed with a peripheral cutout and a portion of an outer contour of said first portion of said at least one movable key combination element slidingly contacts said peripheral cutout.

3. The key device according to claim 1, wherein said first and second portions of said at least one movable key combination element move independently of each other.

4. The key device according to claim 1, wherein said first portion of said at least one movable key combination element comprises a body movably mounted in a hole formed in said shaft portion, said hole being formed with a lower shoulder, and wherein displacement of said first portion of said at least one movable key combination element is constrained by said body abutting against said shoulder.

5. The key device according to claim 1, wherein said second portion of said at least one movable key combination element comprises an oblong body movably mounted in an oblong aperture formed in said shaft portion, said oblong aperture being formed with a lower shoulder, and wherein displacement of said second portion of said at least one movable key combination element is constrained by said oblong body abutting against said shoulder.

6. The key device according to claim 1, comprising a pair of movable key combination elements mounted on opposite sides of said shaft portion.

7. The key device according to claim 6, wherein the first portion of each of said movable key combination elements comprises a first body movably mounted in a hole formed in said shaft portion, said hole being formed with a lower shoulder, and wherein displacement of said first portion of said at least one movable key combination element is constrained by said first body abutting against said shoulder, and wherein the second portion of each of said movable key combination elements comprises an oblong body movably mounted in an oblong aperture formed in said shaft portion, said oblong aperture being formed with a lower shoulder, and wherein displacement of said second portion of said at least one movable key combination element is constrained by said oblong body abutting against said shoulder; and wherein each first body has a shaft extending therefrom and wherein each oblong body is formed with a recess, and the shaft of the first body of one of the movable key combination elements fits into the recess of the oblong body of the other of the movable key combination elements.

* * * * *